US011445308B2

(12) United States Patent
Dickmann et al.

(10) Patent No.: US 11,445,308 B2
(45) **Date of Patent: *Sep. 13, 2022**

(54) METHOD OF CONTROLLING ACCESS TO HEARING INSTRUMENT SERVICES

(71) Applicant: Sonova AG, Staefa (CH)

(72) Inventors: Georg Dickmann, Ebmatingen (CH); Daniel Lucas-Hirtz, Rapperswil (CH); Michael von Tessin, Esslingen (CH); Alexander Maksyagin, Ebmatingen (CH)

(73) Assignee: Sonova AG, Staefa (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/102,476

(22) Filed: Nov. 24, 2020

(65) Prior Publication Data

US 2021/0084419 A1 Mar. 18, 2021

Related U.S. Application Data

(63) Continuation of application No. 16/349,638, filed as application No. PCT/EP2016/077844 on Nov. 16, 2016, now Pat. No. 10,880,661.

(51) Int. Cl.
*H04R 25/00* (2006.01)

(52) U.S. Cl.
CPC ..... *H04R 25/556* (2013.01); *H04R 25/70* (2013.01); *H04R 2225/55* (2013.01)

(58) Field of Classification Search
CPC ..... H04R 25/00; H04R 25/55; H04R 25/602; H04R 2225/31; H04R 2225/33
(Continued)

(56) References Cited

U.S. PATENT DOCUMENTS 9,210,520 B2 12/2015 Solum
2004/0044655 A1 3/2004 Cotner
(Continued)

FOREIGN PATENT DOCUMENTS

EP 3236674 10/2017
WO 2013020045 2/2013
(Continued)

OTHER PUBLICATIONS

European Patent Office, International Search Report and Written Opinion of the International Searching Authority, dated Jul. 25, 2017, 13 pages, European Patent Office, P.B. 5818 Patentlaan 2, NL-2280 HV Rijswijk.
(Continued)

*Primary Examiner* — Suhan Ni
(74) *Attorney, Agent, or Firm* — ALG Intellectual Property, LLC

(57) ABSTRACT

There is provided a method of controlling access of a client to a service of a hearing instrument, the method comprising the steps of: requesting access of the client to the service of the hearing instrument by providing a client authenticator to the hearing instrument; authenticating the client based on a validation of the provided client authenticator by the hearing instrument; upon successful authentication, comparing a security level associated with the service requested by the client with a highest security level assigned to the client by the hearing instrument, wherein the security level is selected from a plurality of hierarchically structured security levels, and granting access of the client to the service of the hearing instrument, if the requested security level is below or equal to the highest security level assigned to the client.

22 Claims, 8 Drawing Sheets

(58) Field of Classification Search
USPC ..... 381/312, 314–315, 323, 331
See application file for complete search history.

(56) References Cited

U.S. PATENT DOCUMENTS

| | | | | |
|---|---|---|---|---|
| 2008/0298614 | A1 | 12/2008 | Cronin | |
| 2009/0076804 | A1 | 3/2009 | Bradford | |
| 2010/0122333 | A1 | 5/2010 | Noe | |
| 2013/0142367 | A1 | 6/2013 | Berry | |
| 2014/0192988 | A1* | 7/2014 | Solum | H04R 25/554 381/23.1 |
| 2015/0318932 | A1* | 11/2015 | Kerselaers | H04R 25/55 381/315 |
| 2016/0100261 | A1 | 4/2016 | Shennib | |
| 2016/0173278 | A1 | 6/2016 | Pedersen | |
| 2017/0075654 | A1* | 3/2017 | Shin | G06F 3/167 |
| 2017/0318457 | A1* | 11/2017 | Westermann | G16H 40/40 |

FOREIGN PATENT DOCUMENTS

| | | |
|---|---|---|
| WO | 2013091693 | 6/2013 |
| WO | 2015028050 | 8/2013 |
| WO | 2015132419 | 9/2015 |
| WO | 2016078710 | 6/2016 |
| WO | 2017101978 | 6/2017 |

OTHER PUBLICATIONS

Opposition received Oct. 14, 2021 against related European Patent Application No. 16798132.3-1207/3542554.

* cited by examiner

METHOD OF CONTROLLING ACCESS TO HEARING INSTRUMENT SERVICES

CROSS-REFERENCED APPLICATIONS

The present application is a continuation of application U.S. application Ser. No. 16/349,638 titled "METHOD OF CONTROLLING ACCESS TO HEARING INSTRUMENT SERVICES," filed on May 14, 2019, which is a national stage entry of International Application No. PCT/EP2016/077844, filed on Nov. 16, 2016, both of which are incorporated herein by reference for their entireties.

TECHNICAL FIELD

The technology relates to a method of controlling the access of hearing instrument services by clients.

BACKGROUND

Typically, hearing instruments such as hearing aids, are equipped with a number of standard and/or proprietary communication interfaces for communication with different kinds of external devices which may act as clients. For example, at manufacturing time, the hearing instrument may communicate with a production system for testing and initial programing; during a fitting session at a hearing care professional it communicates with a fitting station, and when used by the end-user (i.e. the owner of the hearing instrument), it may communicate with applications running on smartphones or other mobile or stationary devices.

In order to be able to communicate wirelessly with a device, such as via a Bluetooth interface, the hearing instrument first has to be paired with it, so as to explicitly grant to the devices an authorization to communicate to each other. According to a known approach, which is illustrated in FIG. 1, client applications running on external devices connected to the same communication interface of a hearing instrument have full access to the hearing instrument, which implies, for example, that any application may modify safety-critical hearing instrument configurations. Hence, such approach is not acceptable for medical-class devices like a hearing instrument.

WO 2015/028050 A1 relates to a system wherein a remote server offers via a communication network various hearing instrument services, primarily concerning configuration and control of the hearing instrument. The access to such "cloud services" may require subscription/payment by the user of the hearing instrument. The cloud services may be used by an audiologist for hearing instrument fitting, support, maintenance and diagnostics. The hearing instrument may be directly connected to the remote server via the communication network or indirectly via a communication/computing device. The communication/computing device and the hearing instrument may be connected "indirectly" via the remote server or "directly" via the communication network; the connection always requires authentication of communication/computing device and the hearing instrument via the remote server in order to protect the hearing instrument.

US 2013/0142367 A1 relates to a method wherein a hearing instrument is connected to a third party system, e.g. a remote server of the manufacturer, via a mobile consumer device, e.g. a smartphone, which is connected to the remote server via a network connection, and which is connected to the HI via a wireless communication channel. Thereby services like diagnoses and firmware update may be provided to the hearing instrument. The mobile consumer device may be e.g. used as a remote control or user interface of the hearing instrument. Access to the hearing instrument may require entering a password by the user or an audiologist in order to connect the hearing instrument to the third party system.

US 2008/0298614 A1 relates to a method wherein a hearing instrument may be adjusted or reprogrammed by a third party service based on individual user data stored in a remote data base for optimizing sound event perception, e.g. in a theater; the access to the remote user data base is restricted, e.g. allowed for registered users only.

WO 2013/091693 A1 relates to a method for remotely controlling, e.g. from a manufacturer's data base or a smartphone, a hearing instrument, wherein the availability of functions/services of the HI may depend on authorization of the user, e.g. by the IMEI of his smartphone, and/or on status information of the hearing instrument ("defect", "stolen", "fitted", etc.) as stored in the data base or on the smartphone; the smartphone may connect to the database via a communication network. A unique identification code is assigned to the hearing instrument and is stored on the hearing instrument and also in the data base and the smartphone, with the status information and the user identification information being assigned to the unique identification code.

U.S. Pat. No. 7,283,842 B2 relates to a method of fitting a hearing instrument, wherein a mobile phone is communicatively connected both to the hearing instrument and to a remote server and then is used as a relay for enabling data/program exchange between the hearing instrument and the remote server; the mobile phone also serves as a user identification by the remote server.

WO 2013/020045 A1 relates to a calibration of a test device via a cloud service, wherein the test device and a mobile device to which the test device can be read out and controlled are both connected to the cloud service. The devices are associated to each other through a user account on the cloud service, wherein both devices have to be logged into the service in order to be able to communicate with each other and use device-specific data stored with the cloud service.

WO 2015/132419 A2 relates to a hearing instrument wherein a production key stored on the hearing instrument at the manufacturer is used for first time pairing of the hearing instrument with a fitting station so as to provide for a convenient and safe pairing process.

SUMMARY

It is an object of the invention to provide for a method of operating a hearing instrument, wherein access to hearing instrument services by clients is to be controlled in an efficient manner.

According to the invention, this object is achieved by a method as defined in the claims.

The invention is beneficial in that it allows to implement a service access control which is enforced on the hearing aid at runtime without the need for an external entity and which provides for client specific service access, while having low resource requirements, taking into account the typically limited resources of hearing instruments, in particular with regard to memory space, power consumption and computational effort.

Preferred embodiments of the invention are defined in the dependent claims.

BRIEF DESCRIPTION OF THE FIGURES

Hereinafter, examples of the invention will be illustrated by reference to the attached drawings, wherein.

DETAILED DESCRIPTION

Figure 2:
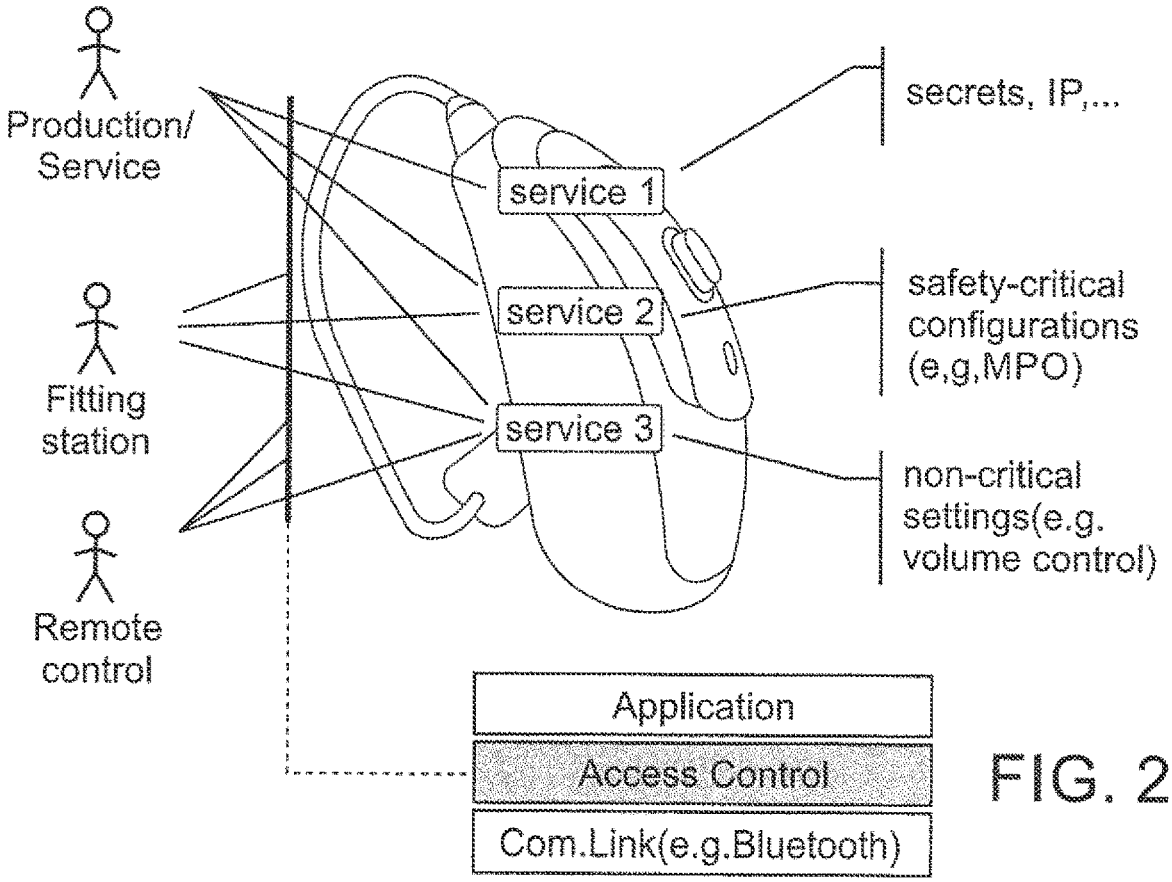
FIG. 2 is an illustration like FIG. 1, wherein, however, a client specific hearing instrument service access control is implemented.

FIG. 2 is a schematic illustration of a hearing instrument service access control which is client specific. The invention addresses the implementation of such client specific hearing service access on a hearing instrument in an efficient manner.

Figure 3:
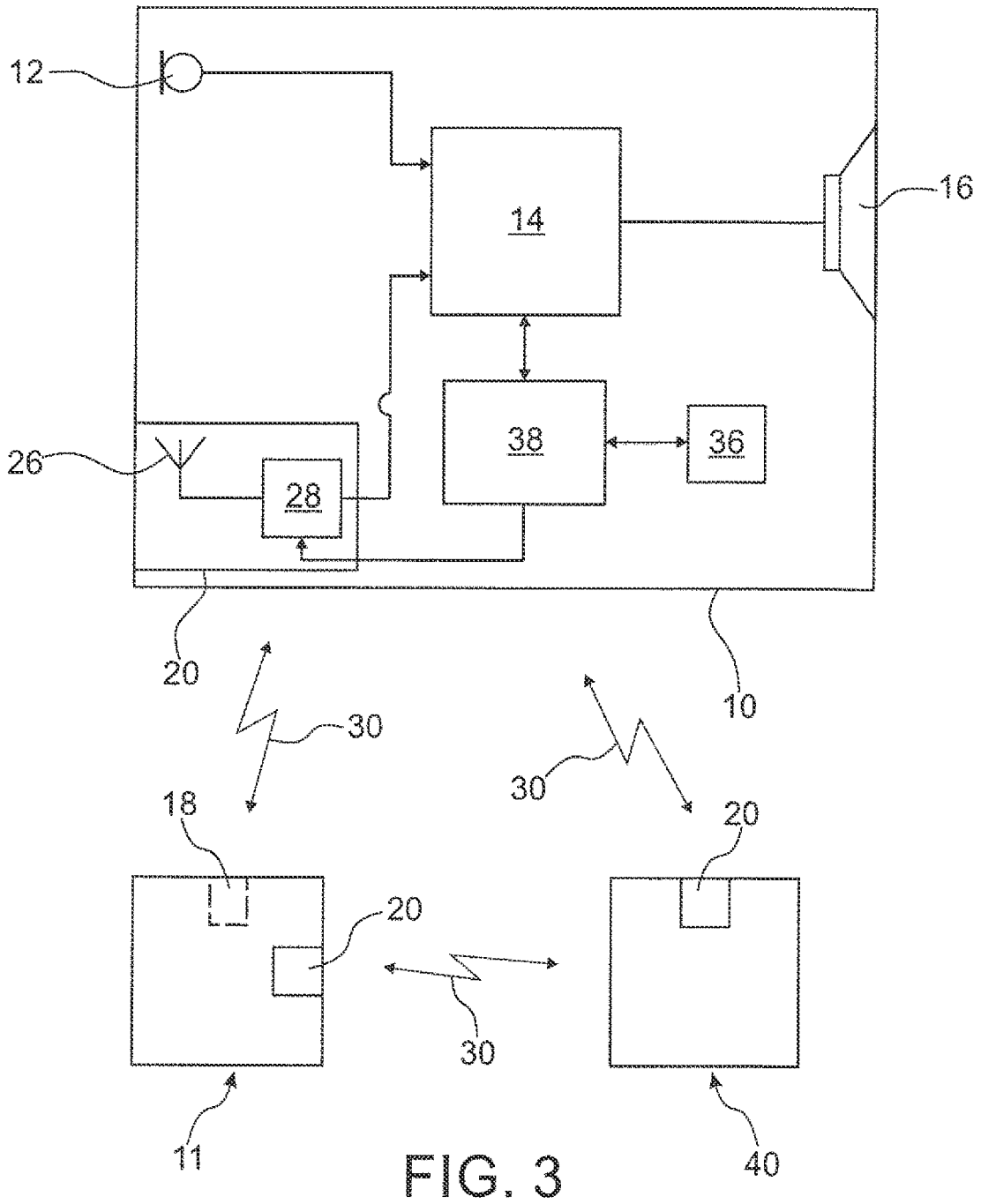
FIG. 3 is a block diagram of a hearing instrument wirelessly connected with external devices.

FIG. 3 is a block diagram of an example of a first hearing device 10 to be worn at one ear of a user which typically is used together with a second hearing device 11 to be worn at the other ear of the user. The first and second hearing devices 10, 11 are ear level devices and together form a binaural hearing system. Preferably, the hearing devices 10, 11 are hearing instruments, such as RIC (Receiver in the canal), BTE (behind-the-ear), ITE (in-the-ear), ITC (in the canal) or CIC (completely-in-the-canal) hearing aids. However, the hearing devices, for example, also could be an auditory prosthesis, such as a cochlear implant device comprising an implanted cochlear stimulator and an external sound processor which may be designed as a BTE unit with a headpiece or as an integrated headpiece.

Figure 1:
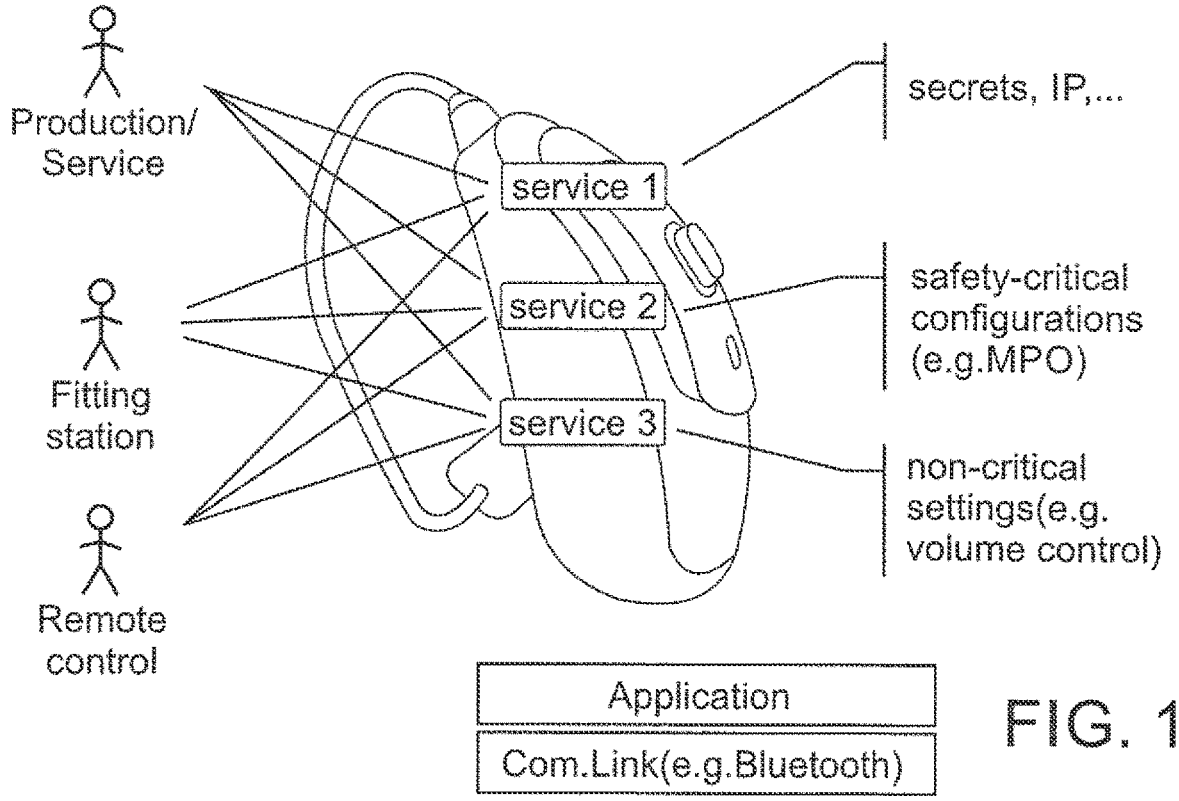
FIG. 1 is an illustration of hearing instrument service access by various clients according to the prior art.

In the example of FIG. 1, the hearing devices 10, 11 are hearing aids comprising a microphone arrangement 12 for capturing audio signals from ambient sound, an audio signal processing unit 14 for processing the captured audio signals and an electro-acoustic output transducer (loudspeaker) 16 for stimulation of the user's hearing according to the processed audio signals (these elements are shown in FIG. 1 only for the hearing aid 10). For example, the audio signal processing in the unit 14 may include acoustic beamforming (in this case, the microphone arrangement 12 comprises at least two spaced apart microphones).

The hearing aids 10, 11 comprise a wireless interface 20 comprising an antenna 26 and a transceiver 28. The interface 20 is provided for enabling wireless data exchange between the first hearing aid 10 and the second hearing aid 11 via a wireless link 30 which serves to realize a binaural hearing assistance system, allowing the hearing aids 10, 11 to exchange audio signals and/or control data and status data, such as the present settings of the hearing aids 10, 11.

The interface 20 is also provided for data exchange via a wireless link 30 from or to a client device 40, for example for receiving an audio data stream from an external device acting as an audio source, or data from a remote control device.

According to one example, the interface 20 may be a Bluetooth interface, preferably a Bluetooth Low Energy (BTLE) interface.

The hearing aids 10, 11 also comprise a control unit 38 for controlling operation of the hearing aids 10, 11, with the control unit 38 acting on the signal processing unit 14 and the transceiver 28, and a memory 36 for storing data required for operation of the hearing aid 10, 11 and data required for operation of the interface 20, such as pairing/network data.

Figure 11:
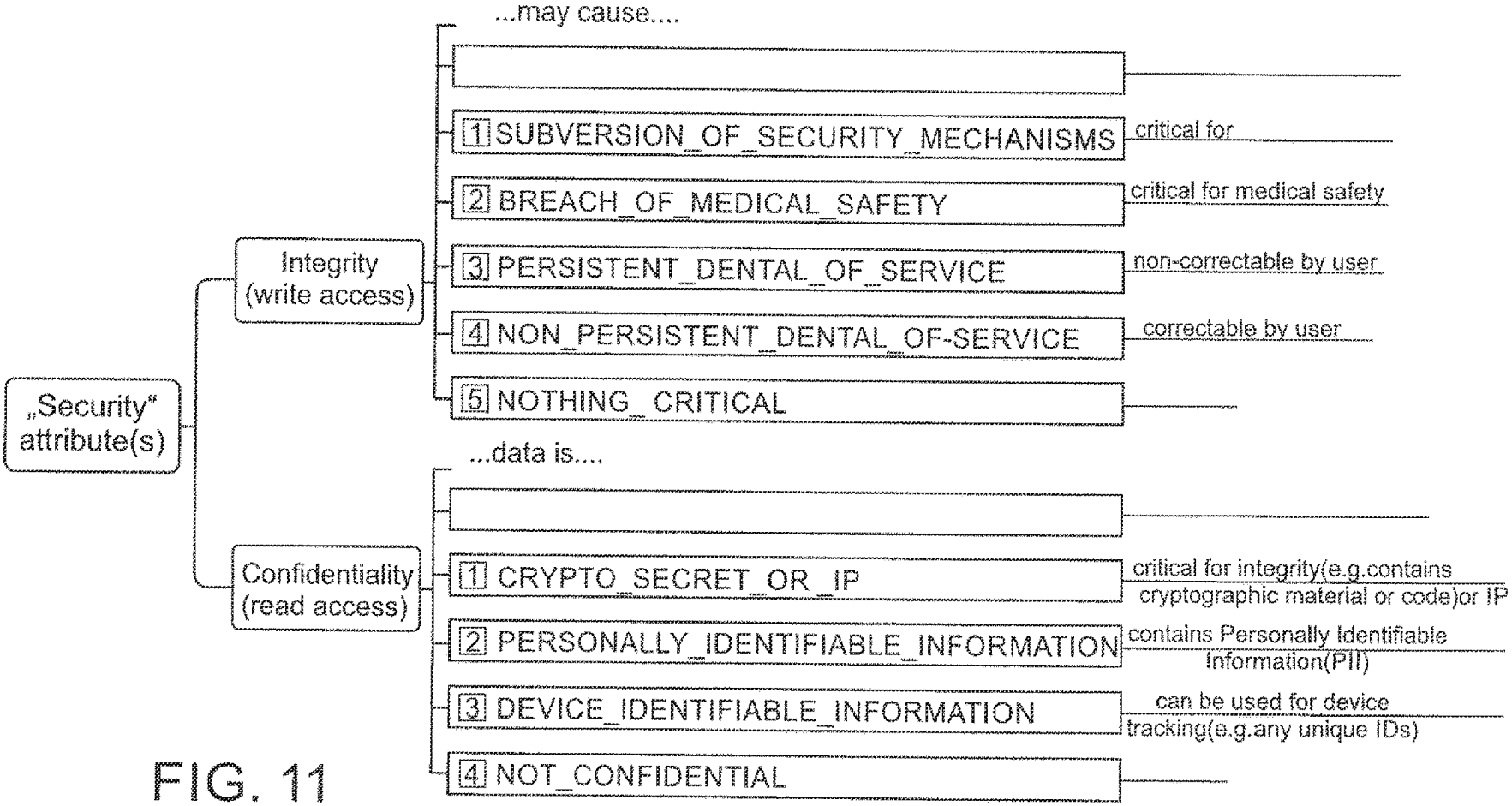
FIG. 11 is an illustration of security attributes which may be used in hearing instrument service access control.

The hearing instrument service access control concept of the invention includes the following main aspects:

A plurality of hearing instrument services is defined, each having a certain criticality, and to each hearing instrument hearing service a security level is assigned which is selected from a plurality of hierarchically structured security levels according to the criticality of the hearing instrument service. In FIG. 11 an example of security attributes which may be taken into account is shown. The "integrity" (write access) takes into account the results the access to a certain service may cause, starting from "nothing critical" as the lowest level up to "subversion of security mechanisms" as the highest criticality level, wherein levels in between may be "non-persistent denial of service" (i.e. result of the write access is correctable by user), "persistent denial of service" (i.e. the result is not correctable by the user) and "breach of medical safety" (i.e. the result may be critical for medical safety). The "confidentiality" (i.e. read access) aspects takes into account the content of the data made accessible by access to the respective hearing instrument service, wherein the lowest level is "not confidential" data up to "secret" (i.e. critical for integrity, e.g. containing cryptographic material or code) as the highest level, wherein the levels "device identifiable information" (i.e. information which can be used for device tracking, such as unique IDs) and "personally identifiable information" are in between.

Figure 12:
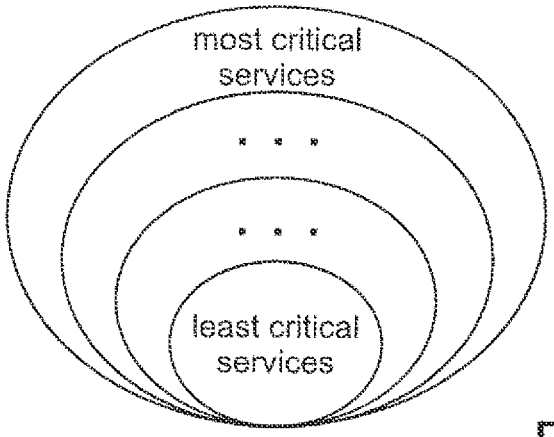
FIG. 12 is an illustration of a hierarchical security classification of hearing instrument services.

In FIG. 12 it is illustrated that the security levels are structured hierarchically in the sense that the access to the highest security level includes access to all lower security levels, i.e. access to the most critical services includes access to all lower security level services, down to the least critical services.

Further, a plurality of authorization methods is defined and at least one of the authorization methods is assigned to each of the security levels in such a manner that each of the authorization method(s) assigned to a certain security level is different to the authorization methods assigned to the other security levels, wherein each authorization method is for granting an authorization to a client to access hearing instrument service(s) assigned with the respective security level.

Figure 13:
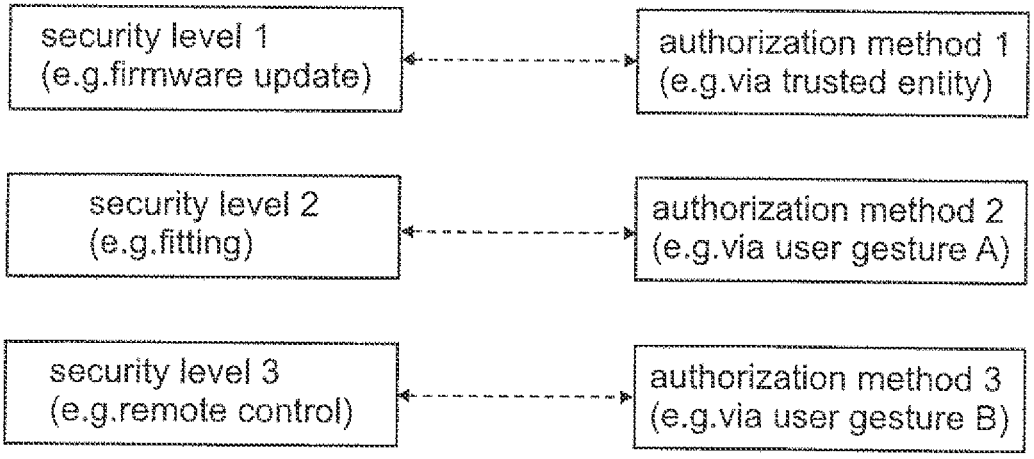
FIG. 13 is an illustration of an assignment of security levels to authorization methods.

An example of such an assignment is schematically illustrated in FIG. 13, wherein a first security level, corresponding for example to a firmware update, is assigned with a first authorization method, such as authorization via an entity trusted by the hearing instrument, a second security level, such as corresponding to a fitting process, is assigned with a second authorization method, for example authorization via a first user gesture, and a third security level, such as corresponding to a remote control access, is assigned with a third authorization method such as authorization via a second user gesture different from the first user gesture.

An authorization comprises at least a client authenticator and the highest security level granted to the client, wherein a client privileged to access a certain security level (as a result of the respective authorization method) is also privileged to access all security levels below that level. At least one of the authorization methods may allow a user to grant authorizations autonomously without involvement of a third entity trusted by the hearing instrument; such autonomous authorization includes acting, in particular by a certain user gesture, on the hearing instrument itself or an external device communicating with the hearing instrument.

The granted authorizations are stored on the hearing instrument so as to allow enforcement of the access control during runtime on the hearing instrument, without the need for a third entity, such as a user account on a remote server.

Runtime enforcement of hearing instrument service access starts once the hearing instrument receives a hearing instrument service access request from a client. Once the client has been authenticated based on the stored client authenticator of the respective client, the security level associated with the hearing instrument service requested by the client is compared to the highest security level granted to the client according to the stored authorization of the client, wherein, if the granted security level is not at least as high as the security level associated with the requested hearing instrument service, the hearing instrument rejects access to the requested hearing instrument service. If the granted security level is at least as high as the security level associated with the requested hearing instrument service, the hearing instrument typically will permit the access to the requested hearing instrument service; however, in some cases, fulfillment of additional requirements may be requested before the access is granted, such as certain type of connection (e.g. wired), etc., as will be discussed in more detail below.

Examples of authorization methods are as follows: authorization by the specific user gesture, authorization by predefined shared secrets, authorization via a third entity trusted by the hearing instrument, and authorization by default.

Figure 4:
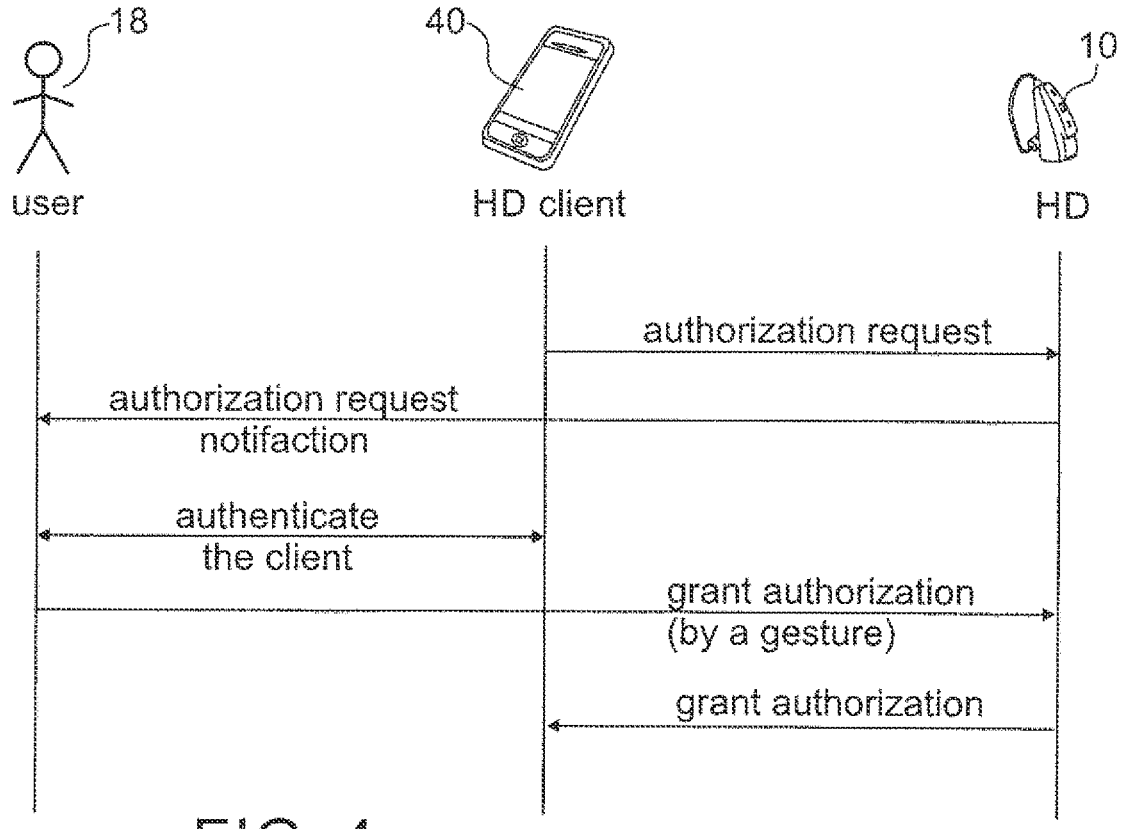
FIG. 4 is an example of a message sequence chart, wherein the user of a hearing instrument grants authorization to a hearing instrument client to hearing instrument services by a gesture to the hearing instrument.

When using different user gestures for authorization, the user, for example, may use a first gesture to grant a full access to the hearing instrument to a fitting station (the user in this case would be a hearing care professional), whereas another gesture can be used to grant access to a restricted set of services of the hearing instrument, for example consisting only of remote control commands. The user may perform an authorization gesture in response to an authorization request from a client, with the hearing instrument informing the user about the reception of the authorization request. If the user decides to grant the requested authorization, the user will perform the respective gesture. Preferably, the user authenticates the requesting client prior to authorizing it. A notification may indicate to the user which privileges are requested by the client; such notification may occur acoustically (e.g. via a voice message or a predefined sound) or visually (e.g. via a LED). An illustration of such authorization method is illustrated in FIG. 4, the method involving a user 18, a client 40 and a hearing instrument 10.

Figure 5:
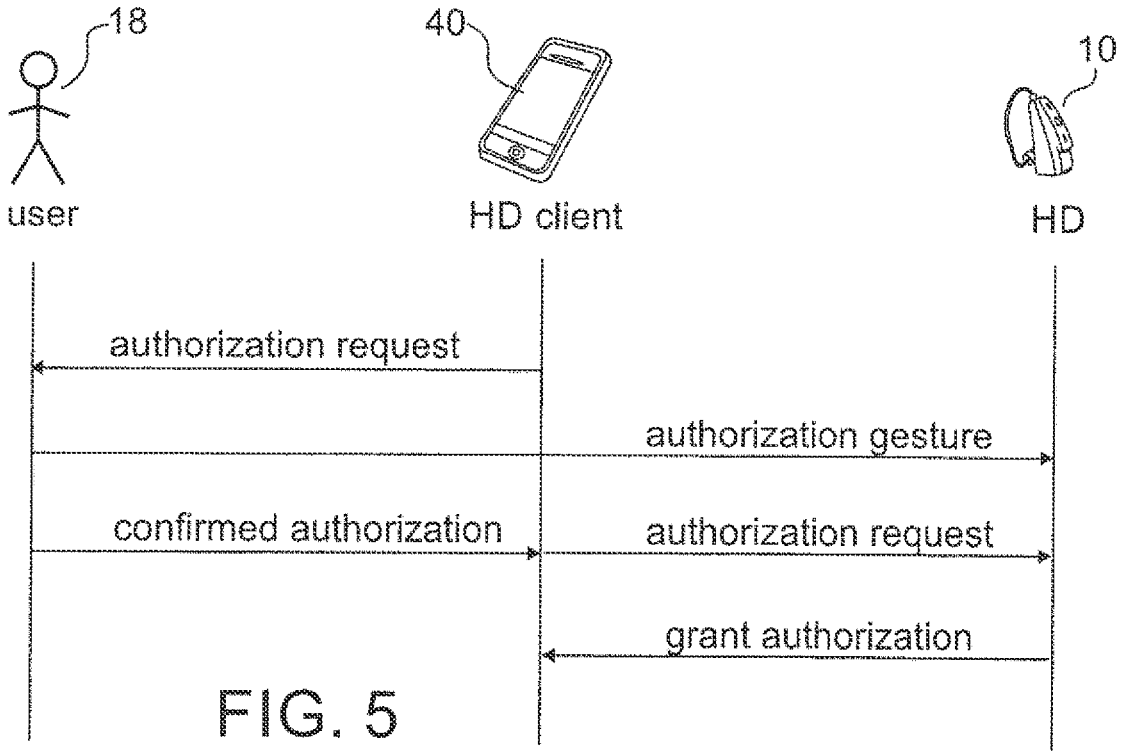
FIG. 5 shows a variation of the message sequence chart of FIG. 4.

Alternatively, the user may first perform an authorization gesture, thereby bringing the hearing instrument into a state in which it accepts authorization requests from any client. Preferably, the hearing instrument informs, upon entry into that state, the user which privileges will be assigned to clients requesting authorization in this state. The user then may cause the desired client to send an authorization request to the hearing instrument, whereupon the hearing instrument notifies the user about successful authorization; such notification may inform the user to which client the authorization has been effectively granted, so that the user may withdraw the authorization in case he recognizes that the authorization was granted to a wrong client. An example of such authorization method is illustrated in FIG. 5.

According to another example, in case of a wireless connection, such as a connection using a Bluetooth protocol, between the client device and the hearing instrument, the pairing process (which authorizes a device wirelessly connected to a hearing instrument) and the authorization of the client (i.e. the assignment of privileges to use a set of services on the hearing instrument) may be combined into one procedure as seen by the user. In such case, the same user gesture may be used at the same time for the pairing process and for the assignment of privileges (i.e. for the authorization process). Alternatively, the pairing gesture may be different from the authorization gestures.

According to one example, the authorization gesture may be performed on a user interface of the hearing instrument. For example, a long press on a button and a short press on a button can be used as different gestures to grant different authorizations (i.e. to assign different sets of privileges). Alternatively, the authorization gesture may be performed on a third device, such as a smartphone, which communicates with the hearing instrument; preferably, such third device is trusted by the hearing instrument.

According to another group of authorization methods, the authorization may comprise authorization by shared secretes, wherein a shared secret is associated with one of the security levels, with the shared secrets being stored on the hearing instrument and being provided to at least one client, and wherein a client is authorized with the requested security level if it presents a valid proof to the hearing instrument that it knows the shared secret. In this case, different sets of privileges (i.e. different authorizations) can be associated with different secret values stored in the hearing instrument, for example at the time of manufacturing. The problem of shared secret distribution to clients can be solved in different ways, e.g.: (1) if the client is under full control of the hearing instrument manufacturer (for example, it is a cloud service owned by the manufacturer), the shared secret can be directly provided to the client; (2) if the client is a fitting station, the shared secret can be provided to it upon successful authentication and authorization of the fitter by the manufacturer; and (3) same as (2) but instead of the fitting station this can be a user (mobile) device; in this case, the manufacturer should be able to authenticate and authorize hearing instrument users. If the shared secrets are not unique to a hearing instrument, but the same for all devices (which is a weak solution from security point of view), then the secrets can be distributed together with the client installation package.

For example, in order to achieve full access to a hearing instrument, a fitting station has to prove to the hearing instrument that it knows a first secret, whereas for an application on a smartphone that needs only to control volume of the hearing instrument, it may be sufficient to prove to the hearing instrument that it knows a second secret.

Figure 6:
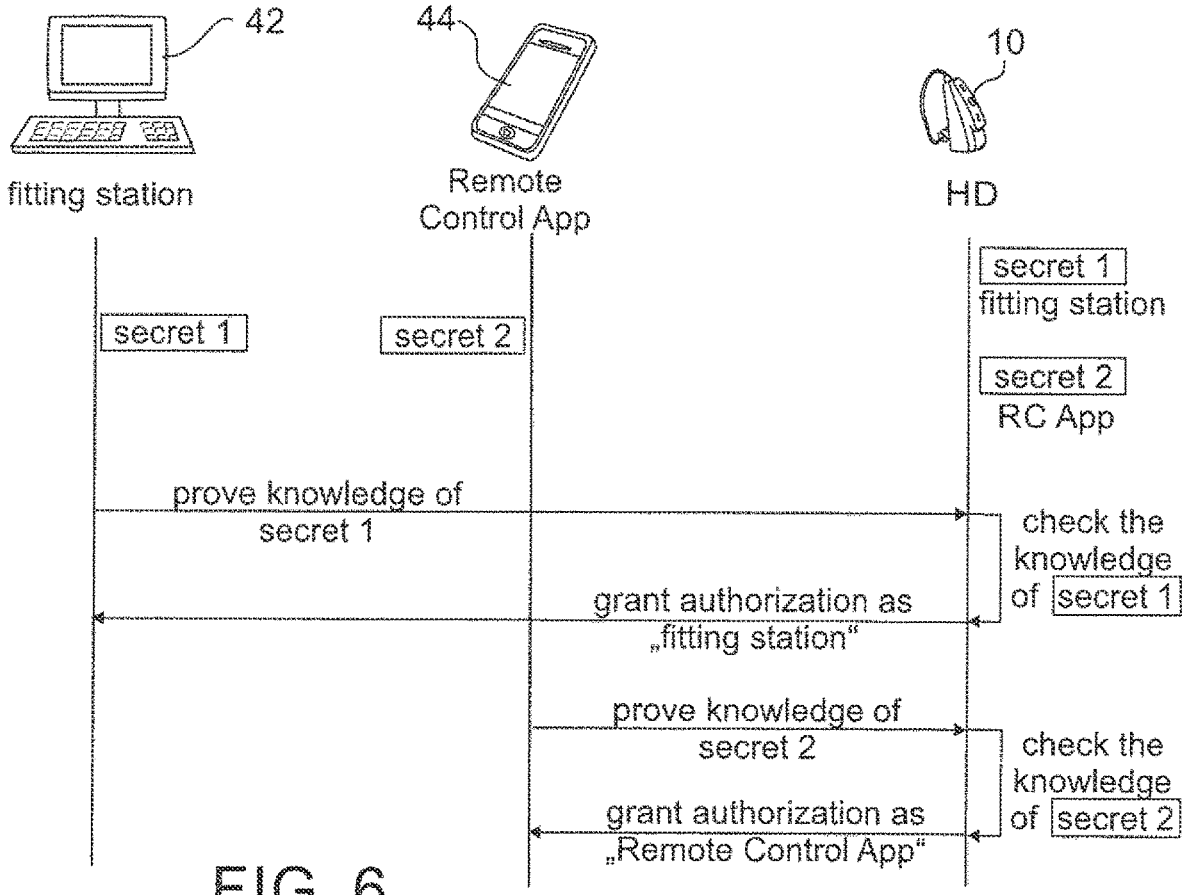
FIG. 6 shows an example of a message sequence chart, wherein authorization to access hearing instrument services is provided to a client via predefined shared secrets.

An example of such authorization method is illustrated in FIG. 6, involving a fitting station 42, a remote control application 44 and a hearing instrument 10.

A client can prove to the hearing instrument that it knows a secret by using different methods, for example, the secret can be communicated in clear text via a communication channel that guarantees confidentiality (like an encrypted Bluetooth link) or the client and the hearing instrument may use a cryptographic challenge-response protocol.

Another group of authorization methods is authorization via a trusted entity. In this case, an authorization service which is an entity trusted by the hearing instrument, is used to authorize hearing instrument clients, wherein a client that desires access to hearing instrument services requests the desired access from the authorization service, for example via a user log-in at the authorization service. If the authorization service decides to grant the requested authorization to the client, it issues a token to the client, which may contain the set of granted privileges. In order to obtain the requested hearing instrument service access, the client then presents the token to the hearing instrument which, if it successfully authenticates the token as issued by the trusted authorization service, then grants the requested set of privileges to the client.

Since such approach is susceptible to the replay attacks a more advanced alternative approach may be used, wherein the hearing instrument issues a 'token' to client. The client provides the token to the authorization service, which (1) signs the token (so called nonce);

and (2) creates and signs a shared key to be used by the client and the hearing instrument (i.e. establishes a trust relation between them). Then the authorization service distributes in a confidential manner the signed token and the key to the client and the hearing instrument. Usually, this is done through the client. Thus two encrypted copies of signed token-key pair are provided first to the client. One copy is encrypted such that only the client can decrypt it. The other copy is encrypted such that only the hearing instrument can decrypt it. The client extracts its copy for itself and forwards the other copy to the hearing instrument. The hearing instrument verifies the authorization service signature and if it is valid, accepts the shared secret (which can be used as the client authenticator). Same is done by the client, if the confidentiality and integrity of the channel between the client and the authorization service are not guaranteed.

For example, if an authorization service can authenticate a person (typically via a user log-in) as a hearing care professional who is authorized to perform fitting of a particular hearing instrument, the authorization service issues to that person a first token granting full access to the hearing instrument. If the authorization service can authenticate a person as the owner/end-user of a hearing instrument (via a user log-in into the authorization service), the authorization service issues to that person a second token granting a limited set of privileges which, for example, is only sufficient to send remote control, commands to the hearing instrument, but not to change its fitting parameters.

The trusted relation between an authorization service and the hearing instrument can be established, for example, based on symmetric cryptography using a secret which is pre-shared between the authorization service and the hearing instrument (for example, the shared secret may be provided at the time of manufacturing of the hearing instrument); preferably, the shared secret is unique for each hearing instrument.

Figure 7:
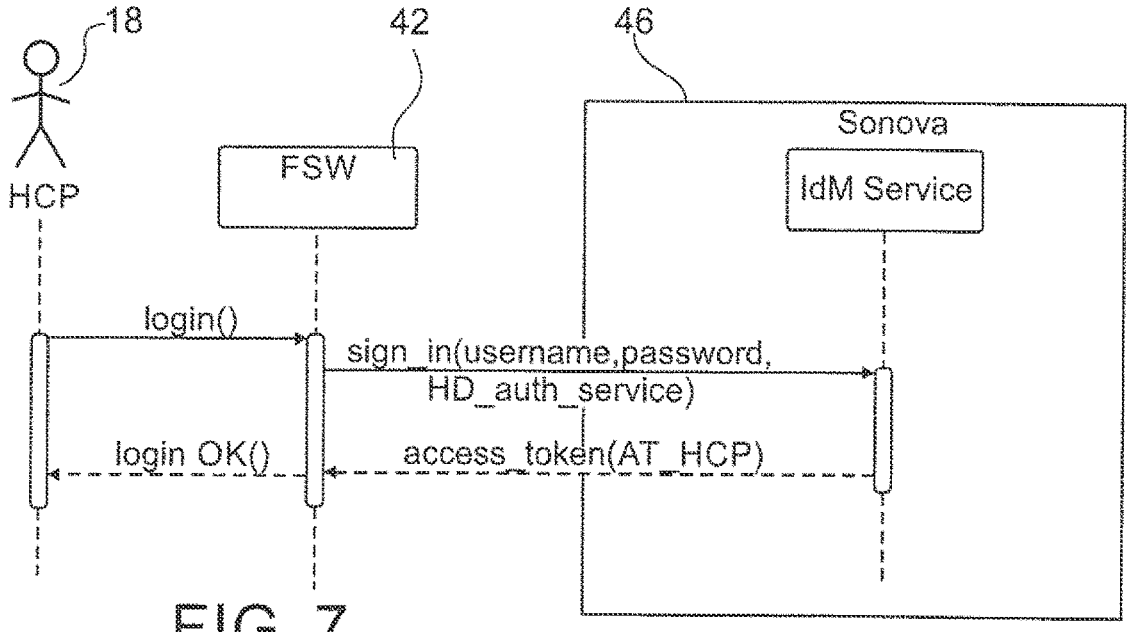
FIGS. 7 and 8 are message sequence charts, which are carried out subsequently, wherein authorization to access hearing instrument services is granted by an entity trusted by the hearing instrument.
Figure 8:
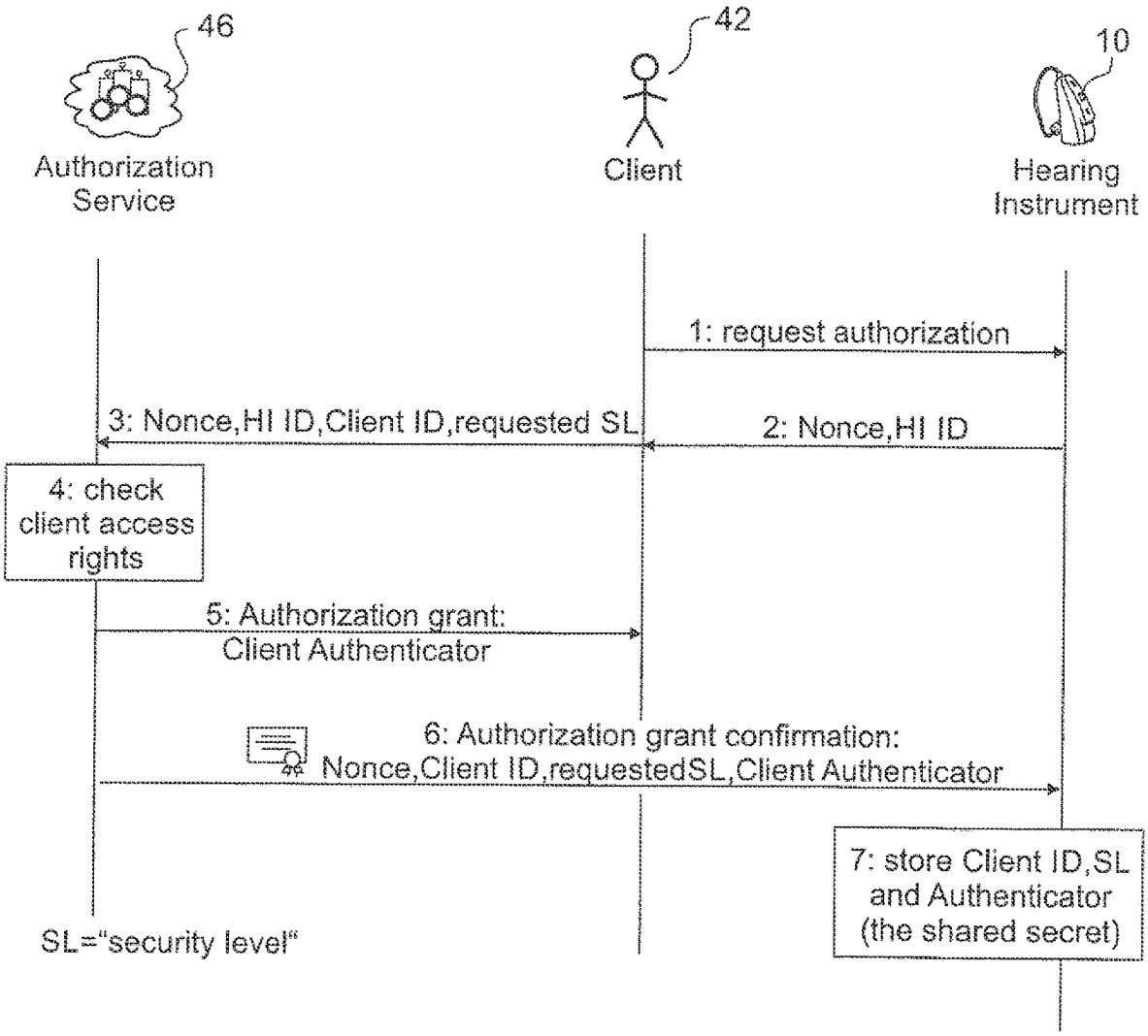

An example of an establishment of a trusted relation is illustrated in FIGS. 7 and 8, wherein the steps shown in FIG. 7 precede the steps shown in FIG. 8, with example involving a hearing care professional 18, a client, such as fitting station 42, a hearing instrument 10 and a manufacturer authorization service 46.

The client authenticates itself with the authorization service 46 by the steps shown in FIG. 7 prior to the message exchange shown in FIG. 8. In step 1 the client 42 requests authorization form the hearing instrument 10. In step 2 a nonce and the hearing instrument ID are sent from the hearing instrument 10 to the client 42; this message can be encrypted with the key pre-shared between HI and the authorization service 46, which key can be a shared or a public key. In step 3 the client send authorization request including the nonce, the hearing instrument ID, the client ID and the requested security level to the authorization service 46, whereupon the authorization service 46 checks the client's access rights (step 4) and sends an authorization grant including the client authenticator to the client 42 (step 5). The channel between the client 42 and the authorization service 46 is assumed to be confidential and integer. In step 6 the authorization service 46 sends an authorization grant conformation message to the hearing instrument, the message including the nonce, the hearing instrument ID, the client ID, the requested security level and the client authenticator. The message is authenticated by authorization service 46 either using the key pre-shared between the hearing instrument and the authorization service 46 or by private key of the authorization service 46. If confidentiality of the channel is not guaranteed, the message can be encrypted with the key pre-shared between the hearing instrument and the authorization service 46 or with a temporary key provided by the hearing instrument within the message of step 2 (the messages of step 2 in this case has to be also encrypted). The message of step 6 can be sent to hearing instrument 10 'directly' or via the client 42.

Thus, the trusted relation may be established based on public key cryptography, wherein the authorization service possesses a private key and the hearing instrument knows the corresponding public key (which may be stored, for example, within the hearing instrument in a write-protected memory); preferably, the public/private key pair is unique for each hearing aid; alternatively, the public/private key pair can be the same for all or for a group of hearing instruments.

The token may be a digital certificate issued by the authorization service to the client, wherein the digital certificate may be signed with the private key of the authorization service and wherein the hearing instrument may use the public key to validate the signature of the certificate in order to verify the certificate. The hearing instrument may install the certificate, when successfully verified, in its write-protected memory. The certificate may be of a standard format and may contain an authenticator of the client to which the certificate is issued, a client public key generated and provided by the client to the authorization service, and the security levels granted to the client. The client private key is stored by the client as a secret. Later on, the hearing instrument can use the client public key to authenticate the client and/or it may use it for any other purposes requiring cryptographically protected confidentiality and integrity of communication, such as for key distribution.

The authorization service may be provided via a communication network, such as the internet; in particular, it may be implemented on a server run by the manufacturer of the hearing instrument.

In addition to the authorization methods described so far, the authorization may occur by default, wherein the hearing instrument unconditionally assigns a given minimum security level to any client requesting authorization; this applies to non-critical hearing instrument services, such as volume control.

As already mentioned above, the result of a successful authorization is a client authenticator and the highest security level granted to the client. Preferably, the client authenticator contains a secret shared between the client and the hearing instrument. According to one example, the shared secret may be established by a cryptographic protocol, such as Diffie-Hellman. Alternatively, the shared secret (i.e. a shared key) may be established between the client and the hearing instrument through the authorization service during the authorization process as exemplified in the message sequence charts in FIGS. 7 and 8. According to a further alternative, if the underlying communication channel ensures confidentiality and integrity, the shared secret may be generated by the client and is transmitted in clear to the hearing instrument (or vice versa). The secret can be a shared key or a private/public key pair.

Later, the shared secret of the client authenticator (which shared secret is to be distinguished from the shared secrets mentioned with regard to the authorization methods) may be used to achieve end-to-end security (i.e. confidentiality and integrity) of the communication between the client and the hearing instrument, if the underlying communication channel is going through untrusted entities, such as the internet (as would be the case for example, in remote fitting).

The above authorization methods may be combined with additional conditions which need to be fulfilled for successful client authorization. For example, the communication interface through which a client accesses the hearing instrument can be taken into account (for instance, such condition may be that an authorization to upgrade firmware from a hearing instrument may be obtainable only through a wired connection, but not through a wireless connection).

Similar methods and mechanisms as described above may be used to revoke a previously granted authorization to hearing instrument services.

The hearing instrument starts to accept service requests from a client only if it is able to successfully authenticate the client.

Figure 9:
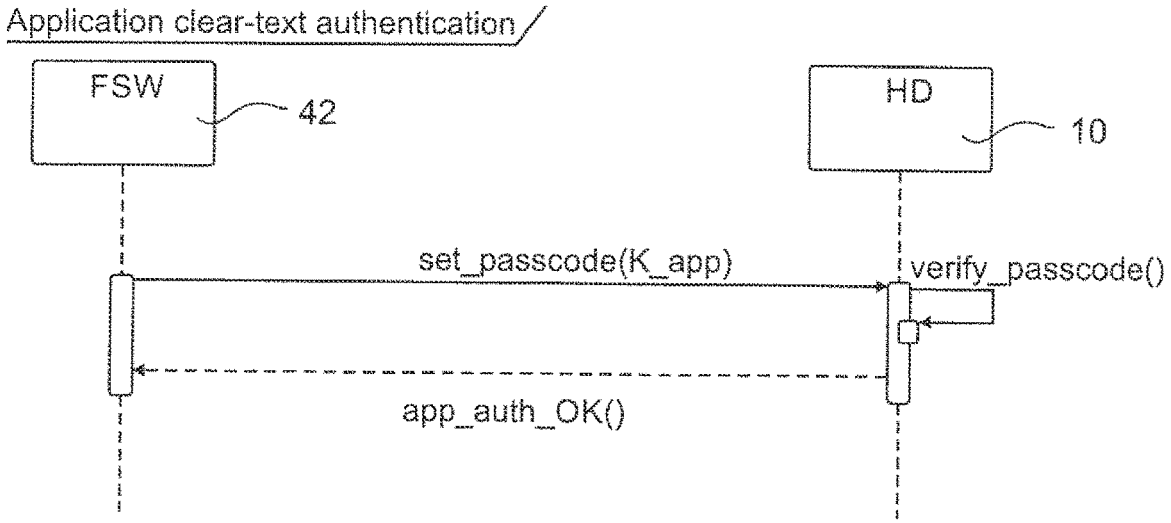
FIG. 9 shows a message sequence chart wherein a client authenticates itself to the hearing instrument.
Figure 10:
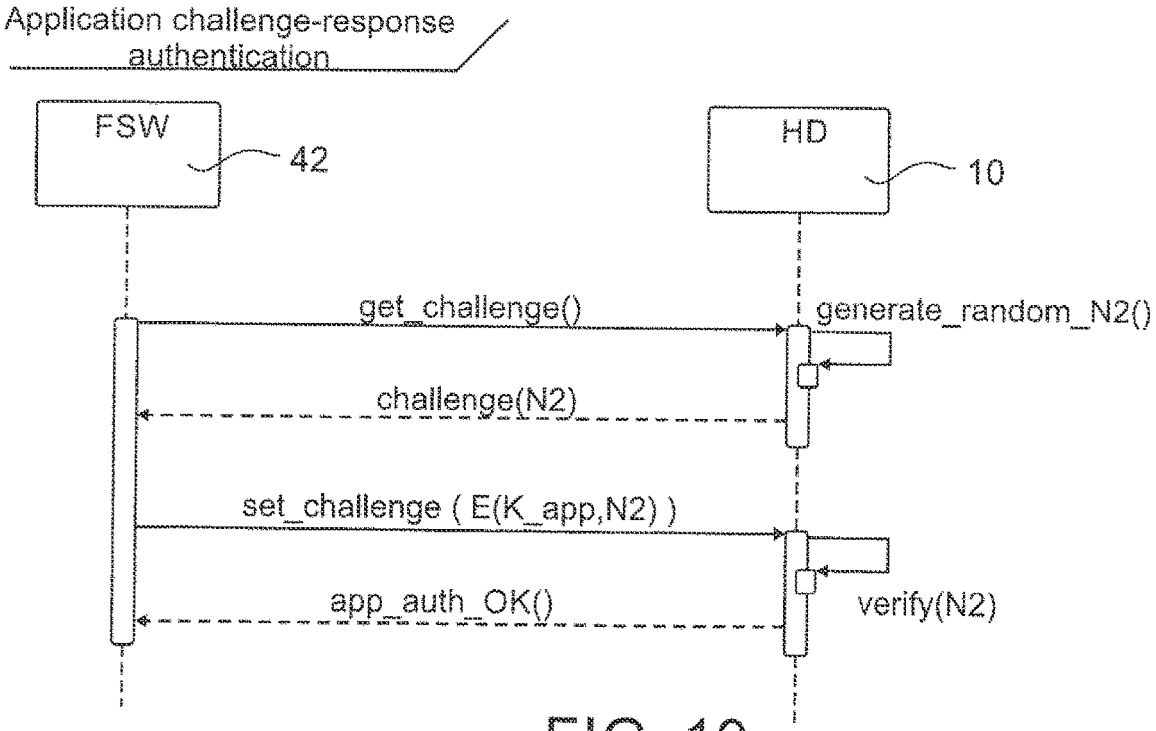
FIG. 10 shows a variant of the message sequence chart of FIG. 9.

If the underlying communication channel between the client and the hearing instrument guarantees confidentiality and integrity, the shared secret established during authorization may be transmitted in clear text from the client to the hearing instrument so as to authenticate the client. An example of such authentication is illustrated in FIG. 9, involving a fitting station 42 and a hearing instrument 10. If the communication channel between the client and the hearing instrument guarantees integrity but not confidentiality, the shared secret established during authorization is used in a cryptographic challenge-response protocol. An example of such authentication is illustrated in FIG. 10.

In both cases, the client authentication needs to be performed only once (for example, upon link establishment), while achieving permanent authentication. However, if the communication channel between the client and the hearing instrument does not guarantee integrity, every single service request by a client has to be authenticated (i.e. there is only a one-time authentication); this may occur by known cryptographic techniques such as message authentication codes (MAC) or digital signatures. By "permanent" it is not necessarily meant that the authentication is done only once and forever. Rather, the authentication is performed in the beginning of each session (assuming the confidentiality and integrity of the channel). For example, it may be performed every time a smart phone re-connects to the HI via Bluetooth, but it can be performed even more often, for example, for every logically self-contained interaction on application level (i.e. session).

Certain (non-critical) service requests may not require a prior client authentication and therefore would be always accepted by the hearing instrument (this corresponds to the above-mentioned "authentication by default").

As already mentioned above, once the hearing instrument has successfully authenticated the client and has found that the security level granted to the client is at least as high as the security level associated with the service request, the hearing instrument typically permits the access to the requested hearing instrument service. However, the hearing instrument may in addition consider at least one of the aspects of the communication link between the client and the hearing instrument, such as the type of interface used in the communication link (wired versus wireless) and/or whether the client is paired with the hearing instrument or not. In other words, the hearing instrument may apply further conditions in addition to the stored authorization of the client. For example, the hearing instrument may grant a certain client access to a certain hearing instrument service only if the client is found to have been authorized and is paired with the hearing instrument and is connected to the hearing instrument via a wired connection.

Preferably, the security levels are represented by the numerical values, with the order of the numerical values being correlated with the hierarchy of the security levels. For example, the security level may be the higher the numerical value representing the security level is. According to one example, a call dispatching table may be stored on the hearing instrument for assigning each hearing instrument service callable by a client to one of the security levels.

According to one example, the security levels (and thus the hearing instrument services associated with the security levels) accessible by a certain client may be expressed by white-listing (listing all services/security levels accessible by the client) or by black-listing (i.e. listing all services/security levels which are not accessible by the client).

According to one example, the clients may be grouped based on the highest security level accessible by the client, with each group being assigned with the respective highest security level accessible by the clients of the group, wherein the hearing instrument permits access to the requested instrument service if the security level associated with the requested hearing instrument service is not higher than the security level of the group of the client, otherwise it rejects the access.

The client may comprise devices, such as fitting stations, hearing instruments, wireless microphones, smartphones, tablets, remote controls or any other custom accessories and audio streaming devices, as well as application programs running on such devices. The clients also may be various internet agents like web applications and on-line services (i.e. not human-operated entities), including those with artificial intelligence, different IoT devices, production and test systems, repair and service stations.

The invention offers several benefits; for example, since the authentication methods include authentication by user gesture, the user keeps control of client access to his hearing instrument. Further, the invention protects the hearing instrument from man-in-the-middle attacks during pairing, while nevertheless the access control may be implemented in a manner that requires only little resources of the hearing instrument.

The invention claimed is:

1. A method of controlling client access to a hearing device, the method comprising:

determining that a communication link is established between the hearing device and a client:

receiving, by the hearing device and from the client by way of the communication link, a request to access a set of services of the hearing device, the request including a client authenticator of the client;

authenticating, by the hearing device, the client based on a validation of the client authenticator; and upon successful authentication of the client by the hearing device, verifying an authorization of the client to access the set of services of the hearing device, the verifying of the authorization including:

granting access of the client to the requested set of services only if the requested set of services is a subset of a set of services the client is authorized for, wherein the authentication of the client by the hearing device and the verifying of the authorization of the client to access the set of services are implemented in one mechanism or in separate mechanisms.

2. The method of claim 1, wherein the set of services is associated with a plurality of hierarchically structured security levels and each hearing device service is assigned to a security level, wherein the client is authorized to access a maximum-security level, wherein the client is only allowed to access a service within the set of services that is assigned to a security level that is equal or lower than the maximum-security level for the client.

3. The method of claim 2, wherein the hearing device, when granting the client access to a certain hearing device service considers, in addition to the authorization of the client, at least one of an aspect of the communication link between the client and the hearing device or an authorization stored on the hearing device.

4. The method of claim 1, wherein the verifying of the authorization is based on one of a plurality of authorization methods and each authorization method included in the plurality of authorization methods is directly assigned to a set of hearing device services, where the hearing device grants access to a service which is in the set of hearing device services assigned to an authorization method included in the plurality of authorization methods that the client is using; or provides a possibility to carry information of which set of services is granted when using the authorization method.

5. The method of claim 4, wherein at least one of the authorization methods included in the plurality of authorization methods enables a user to grant authorizations autonomously by acting on the hearing device or an external device communicating with the hearing device.

6. The method of claim 5, wherein an authorization method included in the plurality authorization methods comprises performing, by the user, a gesture on a user interface of the hearing device or on an external device.

7. The method of claim 4, wherein an authorization method included in the plurality of authorization methods comprises authorization by shared secrets, wherein a shared secret is associated with the set of hearing device services, with the shared secret being stored on the hearing device and is provided to at least one client, and wherein the client is authorized with the set of hearing device services if the client presents proof to the hearing device that the client knows the shared secret.

8. The method of claim 7, wherein there are a plurality of different shared secrets, wherein each shared secret included in the plurality of different shared secrets is associated with a different set of hearing device services.

9. The method of claim 7, wherein the shared secret is established by a cryptographic protocol.

10. The method of claim 9, wherein cryptographic protocol is Diffie-Hellman.

11. The method of claim 9, wherein the shared secret is generated by the client and is transmitted via a communication channel to the hearing device or the shared secret is generated by the hearing device and is transmitted via the communication channel to the client, and wherein the shared secret is a shared key or a private-public key pair.

12. The method of claim 7, wherein the authentication is a permanent authentication, and wherein the shared secret established during the authorization is transmitted in from the client to the hearing device in a confidential communication channel between the client and the hearing device.

13. The method of claim 12, wherein, for one-time authentication, each service request is authenticated by cryptographic techniques if the confidential communication channel between the client and the hearing device does not guarantee integrity.

14. The method of claim 7, wherein the authentication is a permanent authentication, and wherein the shared secret established during authorization is used in a cryptographic challenge-response protocol if a communication channel between the client and the hearing device guarantees integrity but not confidentiality.

15. The method of claim 7, wherein an authorization method included in the plurality of authorization methods comprises authorization by an authorization service, wherein the client identifies itself to the authorization service and requests authorization for access to at least one hearing device service from the authorization service, wherein the authorization service, based on an identity of the client, decides to grant or refuse the requested authorization, wherein the authorization service, when grating the requested authorization, issues a token to the client including the set of hearing device services accessible by the client, wherein the client presents the token to the hearing device, wherein a trusted relation is established between the hearing device and the authorization service, and wherein the hearing device, when successfully authenticating the token as having been issued by the authorization service, grants the requested authorization to the client.

16. The method of claim 15, wherein the client is configured to identify itself to the authorization service via a user login of the authorization service.

17. The method of claim 15, further comprising:

establishing a trusted relationship between the hearing device and the authorization service based on symmetric cryptography using a trust relationship secret shared between the hearing device and the authorization service.

18. The method of claim 17, wherein the trust relationship secret is stored on the hearing device at a manufacturer of the hearing device.

19. The method of claim 15, wherein the trusted relation is established between the hearing device and the authorization service based on public key cryptography wherein the authorization service possesses a private key and the hearing device knows a corresponding public key.

20. The method of claim 19, wherein the corresponding public key is stored on the hearing device in a write-protected memory.

21. The method of claim 1, wherein the hearing device unconditionally assigns a given minimum security level to each client requesting authorization.

22. The method of claim 1, wherein the hearing device is a hearing aid or an auditory prosthesis.

* * * * *